US005884706A

United States Patent [19]

Edwards

[11] Patent Number: 5,884,706

[45] Date of Patent: Mar. 23, 1999

[54] HORIZONTAL SUBSEA TREE PRESSURE COMPENSATED PLUG

[75] Inventor: Jeffrey Charles Edwards, Aberdeen, Scotland

[73] Assignee: Expro North Sea Limited, United Kingdom

[21] Appl. No.: 809,151

[22] PCT Filed: Aug. 31, 1995

[86] PCT No.: PCT/GB95/02048

§ 371 Date: Mar. 20, 1997

§ 102(e) Date: Mar. 20, 1997

[87] PCT Pub. No.: WO96/07812

PCT Pub. Date: Mar. 14, 1996

[30] Foreign Application Priority Data

Sep. 8, 1994 [GB] United Kingdom ..... 9418088

[51] Int. Cl.[6] ..... E21B 33/035

[52] U.S. Cl. ..... 166/335; 166/75.11; 166/368

[58] Field of Search ..... 166/335, 368, 166/86.1, 88.1, 88.4, 97.1, 75.11

[56] References Cited

U.S. PATENT DOCUMENTS

| | | | |
|---|---|---|---|
| 3,166,124 | 1/1965 | Johnson | 166/368 |
| 3,414,056 | 12/1968 | Brown et al. | 166/368 |
| 4,121,660 | 10/1978 | Koleilat | 166/135 |
| 5,372,199 | 12/1994 | Cegielski et al. | 166/368 |
| 5,544,707 | 8/1996 | Hopper et al. | 166/382 |

*Primary Examiner*—Hoang C. Dang

*Attorney, Agent, or Firm*—Gifford, Krass, Groh, Sprinkle, Anderson & Citkowski, P.C.

[57] ABSTRACT

A pressure compensated plug for use with subsea trees is described in which a reservoir of compressible fluid is located from a cavity within a horizontal tree (10) whereby allowing temperature induced volume changes to be absorbed by the compressible fluid without resulting in significant increase in pressure. This is achieved by providing a pressure compensation apparatus (80) in the cavity, the apparatus comprising a housing (82) with a floating piston (86) in a chamber (84). The lower face (96) of the chamber is exposed to compressible fluid in the form of an inert gas, such as nitrogen, which is pre-charged at the surface to the appropriate hydrostatic pressure of the seabed. The volume of gas trapped between the lower piston face and the lower face of the cylinder forms the gas reservoir (94). A compensation cylinder can be attached to the upper section of the lower plug (70) and run and retrieved at the same time as the plug, thereby reducing the number of intervention runs. When the lower plug (70) is set and the cavity isolated, any volume change in the liquid due to temperature increase when the well is producing is compensated by the movement of the piston (86) and subsequent expansion and compression of the inert gas, thus maintaining the cavity pressure at approximately the hydrostatic pressure. This has the result that any pressure increase is limited or obviated and pressure within the tree is within the design pressure of the cap or tree.

12 Claims, 2 Drawing Sheets

HORIZONTAL SUBSEA TREE PRESSURE COMPENSATED PLUG

Figure 1:
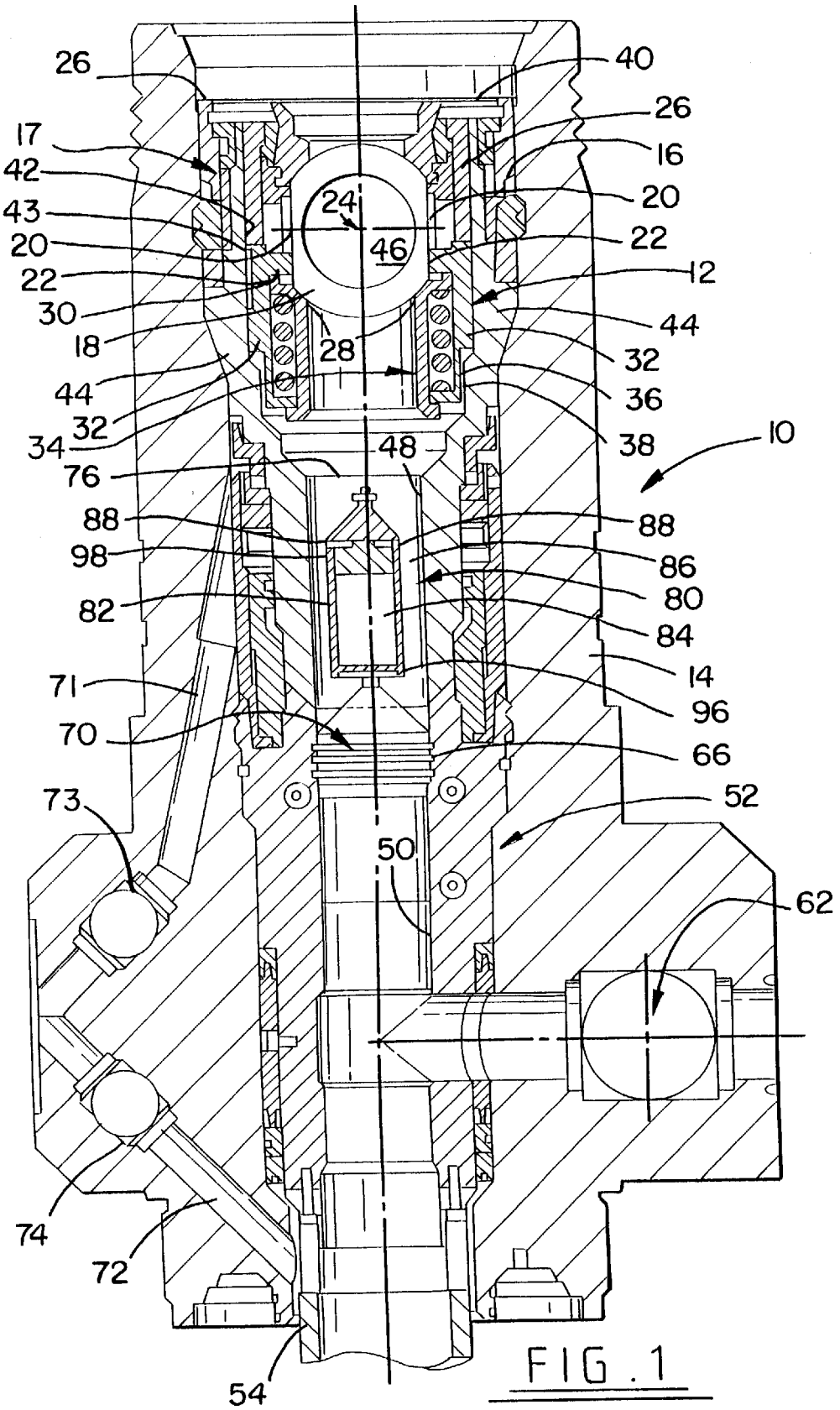

The present invention relates to a pressure compensated plug for use with subsea trees and particularly, but not exclusively, for use with horizontal subsea trees.

The use of horizontal subsea trees is rapidly becoming the norm for subsea completions because of the cost reduction offered over conventional technology. As subsea completions enter deep water, the cost saving increases dramatically, up to 25% in some cases, as reported in an article entitled "Horizontal Trees Provide Quick Wellbore Access", Offshore International Magazine November 1993. A further advantage of horizontal wellheads is that they allow for larger completions to be utilised than conventional technology, thereby allowing an oilfield to be exploited by fewer wells. The conventional method of isolating a horizontal wellhead, after intervention but before production, is carried out by situating a wireline plug in the upper section of the tubing hanger and an additional plug or valve in the upper cap.

A horizontal tree safety valve is described in copending United Kingdom Patent Application No. 9326062.8. This safety valve replaces the upper cap and reduces problems associated with the retrieving of wireline plugs and allowing well access. Although this safety valve offers substantial advantages in comparison with existing technology, it will be understood that it is critical that both systems provide a seal with a high degree of pressure integrity to prevent the communication from the well to the exterior environment which would cause not only significant pollution but would compromise both well integrity and well safety.

Because well intervention is an infrequent requirement, it is normal to achieve seal integrity by using metal-to-metal seals or sealing systems which are not adversely affected by exposure to temperature cycles or to chemical attack. Because the integrity of these seals is critical it is normal practice to perform a pressure test between the seal after either or both plugs are set or the lower plug is set and the safety valve closed. This is done by filling the void space between the plugs or the valve and a plug with an incompressible liquid, such as water, which is then pressurised and monitored for any subsequent reduction in pressure indicating a leak.

Pressurisation is normally performed using an annulus flow line which is connected to the production platform. If the pressure test is satisfactory, the pressure in the cavity between the plugs (or valve and plug) is reduced and an external test port is isolated to provide a secondary barrier between the well bore and the external environment. It will be understood that because the horizontal tree is located in the seabed the process of bleeding the cavity only reduces the pressure to hydrostatic; therefore, this leaves the fluid within the space between the plugs in a partially pressurised condition.

After testing the tree plugs or valve and plug, the well is returned to production by opening a side valve and oil or gas or a mixture of oil and gas flows from the well through the tree and out through the valve. Because the oil and gas producing zones are located in subterranean reservoirs several thousand feet below the seabed, they are, as such, at a substantially higher temperature than the ambient temperature of the horizontal tree. As the well is being used in production, the temperature of the surface equipment increases by heat transfer from the produced effluent. It is well known that if a liquid is heated and its volume is restrained, the pressure of the liquid increases rapidly. This is also true for liquid when it is trapped between the tree plugs or a plug and valve. It will be understood that the increase of pressure of the liquid is a function of the temperature and is not controllable. This increase in pressure could possibly exceed the maximum design pressure of the caps or the tree itself which is an undesirable situation. It will also be understood that the effect of the problem could manifest itself in several undesirable events, such as the inability to retrieve the plugs or failure of the plugs and, indeed, failure of the body of the tree itself.

On object of the present invention is to provide a pressure compensated plug for use with subsea trees which obviates or mitigates at least one of the abovementioned disadvantages.

A further object of the invention is to avoid the possibility of damage to a subsea tree by providing a reservoir of compressible fluid in a cavity within the horizontal tree which would allow temperature induced volume change to be absorbed by the compressible fluid without resulting in significant increase in pressure, thereby maintaining the pressure in the cavity at or around the hydrostatic pressure and lower than the design pressure.

This is achieved by providing a pressure compensation apparatus in the cavity, the apparatus comprising a housing with a floating piston in a chamber. The lower face of the chamber is exposed to compressible fluid in the form of an inert gas, such as nitrogen, which is pre-charged at the surface to the approximate hydrostatic pressure of the seabed. The volume of gas trapped between the lower piston face and the lower face of the cylinder forms the gas reservoir.

The compensation cylinder can be attached to the upper section of the lower plug and run and retrieved at the same time as the plug, therefore reducing the number of intervention runs. When the lower plug is set and the cavity isolated, any volume change in the liquid due to temperature increase, when the well is producing, is compensated by movement of the piston and subsequent expansion and compression of the inert gas, thus maintaining the cavity pressure at approximately hydrostatic pressure. Therefore, pressure increase is limited or obviated and any pressure within the tree is within the design pressure of the cap or tree itself minimising the likelihood of any damage to the plugs or the tree.

According to a first aspect of the present invention, there is provided a pressure compensated plug for use with subsea trees having upper and lower set plugs or a valve and a lower set plug, said pressure compensated plug comprising:

a housing adapted to be coupled to a plug set in a bore of said tree, said housing defining therein a chamber, said chamber having a moveable piston located therein, the piston and the housing defining an inert gas reservoir space, the housing having communication means such that there is communication between one side of the piston and the cavity or space between the plugs or valve and plug, the inert gas reservoir space receiving the inert gas charged at surface to the approximate hydrostatic pressure of the water at the seabed, such that in the event of the fluid in the space between the plugs being heated and increasing in temperature and pressure, the piston moves within the housing chamber to compress the inert gas reservoir thereby relieving pressure between the plugs.

Conveniently, the inert gas is nitrogen. Alternatively, any other suitable inert gas, such as krypton or argon, can be used or a mixture of inert gas and air such that the overall gas is substantially inert.

It will be appreciated that the gas can be separated from the fluid in the chamber by the piston only or there may be two or more pistons may be coupled in series separated by an intermediate or buffer fluid which is incompressible and which acts as a fluid piston coupling force from the piston to the inert gas.

It will be appreciated that the pressure compensated plug can be set during the same time as the lower plug thereby minimising the number of intervention runs.

It will be appreciated that although metal-to-metal seals are preferred they may be replaced by other types of seals using elastomers and the like or a combination of elastomers and metal seals.

It will be understood that the pressure compensated apparatus housing may be releasably coupled to the metal-to-metal seal or may be an integral part of the metal-to-metal seal. The housing has a single port for admitting well fluid and also a port by which pressurised inert gas can be inserted at surface to the desired downhole pressure. The housing is generally cylindrical in shape but may be any other convenient shape.

Preferably, the pressure compensated plug includes pressure monitoring means for monitoring the hydrostatic pressure and for controlling movement of the piston so as to reference the pressure of the inert gas to the hydrostatic pressure and for isolating the reference gas pressure once the plug is set. The pressure compensated plug preferably also includes a preset rupture disc which is set to burst in response to application of a predetermined high pressure which is then bled off. This is used to unreference the cylinder and allow the piston to compensate because the reference gas is exposed to the lower face of the piston and then pressure increase and decrease occurs during and after pressure testing the plugs.

According to another aspect of the present invention, there is provided a method of controlling pressure in a subsea tree after setting upper and lower plugs and as downhole fluid is flowing through the tree for production, said method comprising the steps of, installing a pressure compensated plug between said first and second set plugs or between a first plug and a valve, providing in said pressure compensated plug an inert gas, or substantially an inert gas, reservoir, providing a moveable piston separating said gas reservoir from the remainder of compensation chamber, presetting the gas reservoir pressure to substantially correspond to the downhole subsea hydrostatic pressure, allowing communication between the downhole fluid, the plugs and the remainder of the chamber on the other side of the moveable piston whereby as the temperature of the fluid between the plugs increases and pressure increases, the piston is moved to compress the inert gas, thereby compensating for pressure increase in the fluid between the plugs to maintain said pressure within the design limits of said tree.

Figure 2:
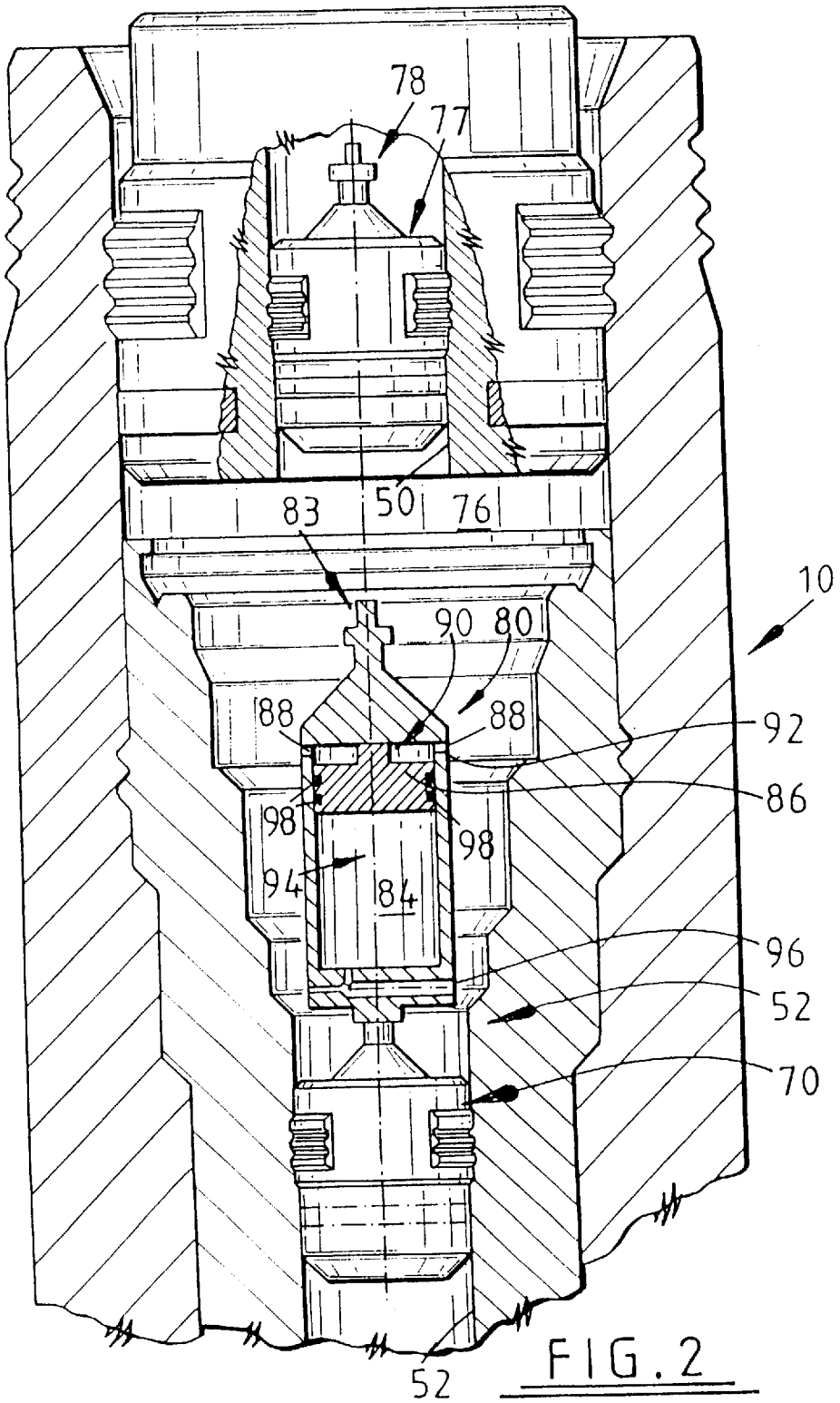

These and other aspects of the invention will become apparent from the following description when taken in combination with the accompanying drawings in which:

FIG. 1 is a longitudinal and part-sectional view through a horizontal subsea tree in which a lower plug with a pressure compensated plug has been installed in accordance with an embodiment of the present invention, and FIG. 2 is an enlarged view of the pressure compensated plug shown in FIG. 1 but with the top ball valve replaced by a top plug.

Reference is first made to FIG. 1 of the drawings which depicts a horizontal subsea tree, generally indicated by reference numeral 10. As disclosed in applicant's copending United Kingdom Patent Application No. 9326062.8, the horizontal tree 10 receives a safety valve operator (not shown in the interests of clarity) which is removable engaged with the tree 10 whereby the safety valve contained in the horizontal tree cap 12 can be opened and closed in accordance with hydraulic control signals from the surface. The horizontal subsea tree cap consists of an outer housing 14 which has, at its top, an internal locking profile 16. It will be understood that the locking profile 16 is generally unique to a particular manufacturer and will vary from manufacturer-to-manufacturer depending on the type of horizontal tree 10. It will also be understood that the internal tree cap will be varied accordingly to fit in with the particular locking profiles of particular manufacturers. The part indicated in hatch lines is generally known as the lower or first valve portion 17 and within portion 17 an apertured ball valve 18 has flat faces 20 into which a slot is machined (not shown in the interests of clarity) for receiving spigots 22 which allow the valve to be moved axially as well to rotate about axis 24 between and open and a closed position. The valve is shown in the closed position in FIG. 1.

The ball element 18 contacts upper and lower valve seats 26,28 respectively for carrying the valve 18. The spigots 22 extend from a fixed ball operating mandrel 32 which defines, with the lower valve seat carrier 28,34, a chamber 36 in which is disposed a coil spring 38 which urges the valve seat 28 against the ball valve 18. The upper ball valve seat 26 is part of an upper latching ring generally indicated by reference numeral 40 which is coupled to the ball cage 30. This combination is sealed to a structural latch cap 42 which is, in turn, secured by a threaded fastener 43 to an outer valve housing 34.

Latch housing 40, ball cage 30, ball element 18 and lower valve seat carrier 34 are movably axially relative to spigots 22 and operating mandrel 32 and as the ball valve is moved down axially it simultaneously rotates from the closed position shown in FIG. 1 to an open position where the bore 46 moves through 90° to be continuous with the bore 48 of upper tree cap 12 and bore 50 of tubing hanger 52.

The tree 10 has a tubing hanger 52 which mates with the lower part of tree cap 10 and which carries tubing 54 at its lower end. A production bore 60 is located at right angles to tubing bore 50 and passes through the tree 10 to a valve 62 which is actuatable to allow well fluid to flow up through the tubing 50 and out through the bore 60 at 90° to the bore 52 when it is desired to flow the well.

The tubing hanger 52 contains threads 66 for receiving a lower well plug 70 (as best seen in FIG. 2) for allowing pressure testing of the horizontal subsea test tree as described above.

It will be seen in FIG. 1 that the horizontal tree has internal conduits 71 and 72 which can be coupled to an annulus flow line (not shown) which is connected to equipment on the surface. On each of the annulus lines a valve 73,74 is located to allow pressure testing. Upper conduit 71 provides connection between the annulus flow line and the space 76 between the upper valve or plug and the lower plug 70 in the horizontal subsea tree and the lower conduit 72 provides connection between the annulus flow line and the bore 50 of the tubing.

The lower plug 70 has a pressure compensating unit generally indicated by reference numeral 80 coupled thereto for providing pressure compensation when the pressure and temperature of the fluid in the space between the plugs rises when hydrocarbon fluid is flowing through the well to compensate for pressure and temperature increases and the operation of this will be described later.

Reference is now made to FIG. 2 of the drawings which depicts part of the horizontal subsea tree shown in FIG. 1, with the lower plug and pressure compensating unit coupled thereto shown in more detail and with the ball valve replaced by a top plug 77. The top plug 77 has an upper fishing neck 78 to facilitate withdrawal of the plug 77 by a fishing tool if required.

It will be seen that the lower plug 70 is set in the bore 50 and the seal between the lower plug 70 and the bore is effected by a metal-to-metal seal to provide more effective sealing during pressure testing. The pressure compensating unit 80 consists of a generally cylindrical housing 82 with a generally cylindrical chamber 84 defined therein. The top of the housing 82 terminating in a fishing neck 83 which is indentical to neck 77 to allow the compensating unit 80 and lower plug 70 to be fished. Disposed in the chamber 84 is a moveable piston 86 which is sealably connected to the walls of the housing. Communication ports 88 are located through the wall of the housing to provide communication between fluid in the space 76 between the plugs, and the space is generally indicated by reference numeral 90, and the space between the top surface 92 of the piston and the housing cap. On the other side of the piston is disposed an inert gas reservoir 94 which is pressurised at surface to substantially the hydrostatic pressure of the fluid in the space under normal conditions. The inert gas is inserted or charged into the space 94 by means of a charging port 96 disposed in the base of the housing. The piston has elastomeric seals 98 disposed on its periphery to provide a seal between the piston 86 and the wall of the housing 82 so as to prevent any leakage of liquid or gas past the piston 86. When the pressure compensating unit is charged at the surface, the pressure of the inert gas, such as nitrogen, in the space forces the piston to the position shown and in normal hydrostatic operation the piston will remain in this position when in a subsea tree.

In use, when the side valve 62 is opened and hydrocarbon fluids and their gases flow up through the tubing and out through the bore 60, there is heat transfer between these fluids and the subsea tree and other fluids and this causes an increase in temperature in the fluid remaining in the space 76 between the upper valve or plug and lower plug. As mentioned above, as the temperature increases so does the pressure of the fluid and, in extreme cases, this can damage the components and the tree itself. With the pressure compensating unit in place, as the temperature of the fluid in the space 76 increases, its pressure increases and the increase in pressure forces the piston 86 to move down within the chamber 84 in the housing 82 against the pressure of the inert gas reservoir, thereby relieving pressure on the components so that the pressure of the fluid acting on the components is within the design limitation of the components. As the temperature of the fluid, and thus the subsea tree, varies the pressure exerted on the piston 86 will vary and, consequently, the inert gas pressure will cause the piston to move up and down within the chamber 84 thereby compensating for pressure changes.

It will be appreciated that various modifications may be made to the embodiment hereinbefore described without departing from the scope of the invention. It will be seen that the pressure compensating unit is shown coupled to the lower plug. However, the pressure compensating unit could be integral with the lower plug so that the lower plug and pressure compensating unit are installed at the same time or the pressure compensating unit could be installed after the lower plug is installed. It will also be appreciated that although the fluid is separated from the gas reservoir by the piston, more than one piston could be used and an intermediate non-compressible buffer fluid could be used in addition to the piston to provide extra separation between the inert gas and the hydrocarbon fluid in the space. It will also be appreciated that the inert gas, although specified as nitrogen, may be any other suitable inert gas, such as argon on krypton or a mixture of these gases or even a mixture of nitrogen and air such that the overall gas is substantially inert.

Although the pressure compensating unit is shown coupled to the lower plug, it will be appreciated that where two plugs are used the pressure compensating unit could be coupled to either the lower or the upper plug as long as it extends into the void space between the plugs.

It will also be understood that pressure monitoring means may be coupled to the pressure compensating unit for automatically referencing the inert gas pressure to the actual hydrostatic pressure within the well bore and for isolating the reference gas pressure when the plug is set. The advantage of this arrangement would be that the effect of the pressure test on the pressure compensating system would be eliminated. This may be achieved by providing a pressure rupture disc which is burst by the application of a higher pressure and then the higher pressure bled off to expose the reference gas in the lower face of the piston so that once this has occurred the pressure increase and decrease would occur as normal after the pressure test has been performed on the plugs.

It will be appreciated that the principal advantage of the invention is that the effect of temperature and pressure increase in fluid between the plugs and/or top valve and the lower plug is compensated thereby minimising the effect of any pressure increase on the components of the subsea test assembly or on the tree itself so that the components and tree are able to operate within their design specifications.

I claim:

1. A pressure compensated unit for use with subsea trees having upper and lower set plugs or a valve and a lower set plug, said pressure compensated unit comprising:

a housing adapted to be coupled to a plug set in a bore of said tree, said housing defining therein a chamber, said chamber having a moveable piston located therein, the piston and the housing defining an inert gas reservoir space, the housing having communication means such that there is communication between one side of the piston and the cavity or space between the set plugs or valve and set plug, the inert gas reservoir space receiving the inert gas charged at surface to the approximate hydrostatic pressure of the water at the seabed, such that in the event of the fluid in the space between the set plugs or valve and set plug being heated and increasing in temperature and pressure, the piston moves within the housing chamber to compress the inert gas reservoir thereby relieving pressure between the set plugs or valve and set plug.

2. A pressure compensated unit as claimed in claim 1 wherein the inert gas is nitrogen.

3. A pressure compensated unit as claimed in claim 1 wherein the inert gas is mixed with air such that the overall gas is substantially inert.

4. A pressure compensated unit as claimed in claim 1 wherein the gas is separated from the fluid in the chamber by a single piston.

5. A pressure compensated unit as claimed in claim 1 wherein the gas is separated from the fluid in the chamber by two or more pistons coupled in series and separated by an intermediate or buffer fluid which is incompressible and which acts as a fluid piston coupling the force from the piston to the inert gas.

6. A pressure compensated unit as claimed in claim 1 wherein the pressure compensated plug unit is set at the same time as the lower set plug thereby minimising the number of intervention runs.

7. A pressure compensated unit as claimed in claim 1 wherein metal-to-metal seals are disposed between the housing and the a housing of the tree.

8. A pressure compensated unit as claimed in claim 7 wherein the tree housing is releasably coupled to the metal-to-metal seal or is an integral part of the metal-to-metal seal.

9. A pressure compensated unit as claimed in claim 1 wherein the housing has a single port for admitting well fluid and also a port by which pressurised inert gas can be inserted at surface to the desired downhole pressure.

10. A pressure compensated plug as claimed in claim 1 wherein the housing is generally cylindrical in shape.

11. A pressure compensated unit as claimed in claim 1 wherein the pressure compensated plug includes a preset rupture disc which is set to burst in response to application of a predetermined high pressure which is then bled off.

12. A method of controlling pressure in a subsea tree after setting an upper set plug or closing an upper valve and setting a lower set plug and as downhole fluid is flowing through the tree for production, said method comprising the steps of, installing a pressure compensated unit between said upper and lower set plugs or between a lower set plug and an upper valve, providing in said pressure compensated unit an inert gas, or substantially an inert gas reservoir, providing a moveable piston separating said gas reservoir from a remainder of the compensation chamber, presetting the gas reservoir pressure to substantially correspond to the downhole subsea hydrostatic pressure, allowing communication between the downhole fluid, the set plugs and the remainder of the chamber on the other side of the moveable piston whereby as the temperature of the fluid between the set plugs or set plug and valve increases and pressure increases, the piston is moved to compress the inert gas, thereby compensating for pressure increase in the fluid between the set plugs or set plug and valve to maintain said pressure within the design limits of said tree.

* * * * *